US011697573B2

(12) United States Patent
Rocher et al.

(10) Patent No.: US 11,697,573 B2
(45) Date of Patent: Jul. 11, 2023

(54) HOISTWAY ACCESS LADDER STORAGE

(71) Applicant: Otis Elevator Company, Farmington, CT (US)

(72) Inventors: Jean-Emile Rocher, Lorris (FR); Vincent Lopez, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 165 days.

(21) Appl. No.: 16/951,112

(22) Filed: Nov. 18, 2020

(65) Prior Publication Data

US 2021/0403285 A1 Dec. 30, 2021

(30) Foreign Application Priority Data

Jun. 26, 2020 (EP) ..... 20305709

(51) Int. Cl.

| | |
|---|---|
| ***B66B 5/00*** | (2006.01) |
| ***B66B 9/00*** | (2006.01) |
| ***B66B 13/08*** | (2006.01) |
| ***B66B 13/30*** | (2006.01) |
| ***E06C 9/08*** | (2006.01) |

(52) U.S. Cl.

CPC ..... *B66B 5/0087* (2013.01); *B66B 9/00* (2013.01); *B66B 13/08* (2013.01); *B66B 13/306* (2013.01); *E06C 9/085* (2013.01)

(58) Field of Classification Search

CPC ..... B66B 5/0087; B66B 13/08; B66B 13/306; E06C 9/085

See application file for complete search history.

(56) References Cited

U.S. PATENT DOCUMENTS

2019/0233252 A1* 8/2019 Philippe ..... B66B 5/0087

FOREIGN PATENT DOCUMENTS

| | | | | |
|---|---|---|---|---|
| CN | 203255823 U | | 10/2013 | |
| EP | 3088342 A1 | * | 11/2016 | ..... B66B 11/0246 |
| EP | 3263827 A1 | | 1/2018 | |
| JP | 2015074538 A | * | 4/2015 | |
| KR | 200486355 U | | 5/2018 | |
| WO | WO-2020022686 A1 | * | 1/2020 | ..... B66B 11/0226 |
| WO | 2019064513 A1 | | 5/2020 | |

OTHER PUBLICATIONS

Machine Translation of WO 2019/064513.*

European Search Report for Application No. 20305709.6; dated Jan. 12, 2021; 8 Pages.

* cited by examiner

*Primary Examiner* — Diem M Tran

(74) *Attorney, Agent, or Firm* — Cantor Colburn LLP

(57) ABSTRACT

A storage system (500) for an elevator hoistway access ladder (300) includes a landing doorway (502) comprising a door column (504) and a landing door (506). The door column (504) includes a rotating support (501) for storing the hoistway access ladder (300), and the rotating support is rotatable relative to the door column (504).

12 Claims, 7 Drawing Sheets

HOISTWAY ACCESS LADDER STORAGE

FOREIGN PRIORITY

This application claims priority to European Patent Application No. 20305709.6, filed Jun. 26, 2020, and all the benefits accruing therefrom under 35 U.S.C. § 119, the contents of which in its entirety are herein incorporated by reference.

TECHNICAL FIELD

This disclosure generally relates to storage systems for a hoistway access ladder for an elevator system. This is achieved by storing a ladder inside a column of a hoistway landing door, or in a support mounted to a door column, to ensure the hoistway access ladder can be safely accessed by maintenance personnel from a landing regardless of the dimensions of the hoistway.

BACKGROUND

It is known for a dedicated hoistway access ladder to be provided for use in an elevator hoistway, for example to access the elevator pit or elevator car for repairs or maintenance. In conventional approaches, the hoistway ladder apparatus is located in the elevator hoistway in a retracted position, e.g. mounted on a wall of the hoistway, from which it must be retrieved in the event that maintenance is required to be carried out. In this approach, the dimensions of the hoistway must be such that sufficient space for the hoistway access ladder is available. Additionally, when the hoistway access ladder is stored within the hoistway, maintenance personnel may be required to use other equipment, such as ropes or bars, to safely retrieve the hoistway access ladder, the requirements of which will vary depending on the size of the hoistway.

Another storage method known from the prior art is to store the hoistway access ladder within a panel of a hoistway landing door. However, this approach is unsuitable for elevator systems employing sliding landing bay doors. Various doors may not have appropriate dimensions to allow a hoistway access ladder to be stored on or in the doors. Furthermore, the weight of a ladder and its fixings may be detrimental to proper operation of the doors.

The present disclosure seeks to provide an alternative approach.

SUMMARY

According to a first aspect of this disclosure, there is provided an elevator hoistway access ladder storage system comprising a hoistway access ladder and a landing doorway, the landing doorway comprising a door column and a landing door, wherein the door column comprises a cavity, and wherein the hoistway access ladder is stored within the cavity of the door column.

In an elevator hoistway access ladder storage system as disclosed herein, a hoistway access ladder can be stored in and safely retrieved from the cavity by an operator on the landing without risking the safety of the operator, and without the use of additional equipment such as ropes or bars.

It is desirable for the hoistway access ladder to be securely stored within the cavity in order for it to be prevented from falling into the hoistway. Thus, in one or more examples of the present disclosure, the elevator hoistway access ladder storage system further comprises at least one restraining element arranged to hold the hoistway access ladder in the interior of the cavity.

In one or more examples of the present disclosure, the elevator hoistway access ladder storage system further comprises a rotating support mounted to the door column to support the hoistway access ladder within the cavity. The use of such a rotating support allows the hoistway access ladder to be accessed more easily by an operator, e.g. by moving the rotating support in and out of the cavity. The Applicant has realised that such a rotating support can provide for more easy retrieval of a hoistway access ladder regardless of whether the hoistway access ladder is stored within the cavity as described above, or elsewhere in the elevator hoistway.

According to a second aspect of this disclosure, there is provided an elevator hoistway access ladder storage system comprising a landing doorway, the landing doorway comprising a door column and a landing door, wherein the door column comprises a rotating support for storing a hoistway access ladder, the rotating support being rotatable relative to the door column.

Thus according to this second aspect of the disclosure, a hoistway access ladder can be stored in and safely retrieved from the rotating support by an operator on the landing without risking the safety of the operator, by rotating the rotating support to a convenient position for the operator to reach the hoistway access ladder. This may avoid the need for additional equipment such as ropes or bars.

In one or more examples according to the second aspect of the present disclosure, the door column of the elevator hoistway access ladder storage system comprises a cavity, and the rotating support is rotatable between a first position inside the cavity, and a second position inside the landing doorway. By storing the rotating support within a cavity of the door column, the amount of space taken up by the rotating support when not in use can be reduced.

In one or more examples of the present disclosure, the rotating support of the elevator hoistway access ladder storage system comprises at least one retaining element arranged to hold a hoistway access ladder in a storage position in the rotating support during use. The use of a retaining element ensures that the hoistway access ladder remains within the rotating support when it is rotated between the first and second positions.

In some examples, the at least one restraining element mentioned above in relation to the first aspect of the present disclosure may be replaced by the at least one retaining element of the rotating support. In other examples, the elevator hoistway access ladder storage system includes the at least one retaining element arranged to hold the hoistway access ladder in a storage position in the rotating support during use, and at least one restraining element arranged to hold the rotating support in the interior of the cavity when in the first position. Thus the rotating support may itself be held in its first position in the cavity.

In one or more examples of the present disclosure, the landing door of the elevator hoistway access ladder storage system is a side opening door. In one or more examples of the present disclosure, the landing door of the elevator hoistway access ladder storage system is a telescopic side opening door. The use of a side opening door in the system of the present disclosure simplifies access to the hoistway access ladder that may otherwise be at least partially blocked when central opening landing doors are used.

In one or more examples of the present disclosure, the hoistway access ladder of the elevator hoistway access ladder storage system is a foldable ladder. While the system of the present disclosure can in principle be used with many kinds of folding ladder, in one or more examples of the present disclosure, the hoistway access ladder of the elevator hoistway access ladder storage system is a foldable ladder comprising a pair of uprights connected by rungs, and the hoistway access ladder is foldable into a storage configuration by moving the uprights together.

According to another aspect of the present disclosure, there is provided an elevator system comprising an elevator car arranged to move in an elevator hoistway, and at least one landing in the hoistway comprising a landing doorway, wherein the landing doorway comprises the elevator hoistway access ladder storage system as described in any of the previously described examples.

In one or more examples, the landing doorway of the elevator system is situated at a lowermost landing of the elevator hoistway. In this way the hoistway access ladder storage system may be used to store an elevator hoistway access ladder for access to an elevator pit, i.e. a pit access ladder.

In any of the examples disclosed herein where the door column comprises a cavity, it will appreciated that the cavity may pre-exist in the door column or the cavity may be formed in the door column when creating the elevator hoistway access ladder storage system. In one or more examples, the cavity extends vertically along the door column. The cavity may extend along at least 50%, 60%, 70%, 80%, or 90% of the height of the door column. In one or more examples, in addition or alternatively, the cavity is an open-sided channel, for example an open-sided channel having a width and/or depth much smaller than its length. The cavity and the hoistway access ladder (whether foldable or not) may be dimensioned to match, such that the hoistway access ladder substantially fills the cavity.

According to another aspect of this disclosure, there is provided a method of storing a hoistway access ladder in a landing doorway of an elevator hoistway, the method comprising storing a hoistway access ladder in a cavity of a door column of a landing doorway. The Applicant has realised that at least some existing elevator systems include landing doorways comprising door columns in which there is a pre-existing cavity. The Applicant has realised that such a door column cavity can advantageously be used to store a hoistway access ladder. In order to assist with storing and retrieving the hoistway access ladder, in at least some examples a rotating support for the hoistway access ladder (e.g. as described above) is retrofitted to such a door column.

According to yet another aspect of this disclosure, there is provided a method of storing a hoistway access ladder in a landing doorway of an elevator hoistway, the method comprising: mounting a rotating support to a door column of a landing doorway, the rotating support being rotatable relative to the door column; and storing a hoistway access ladder in the rotating support. Mounting or retrofitting a rotating support to a door column of a landing doorway may allow pre-existing elevator systems to be modified to enable safe and convenient storage of a hoistway access ladder, regardless of whether the door column includes a cavity or not. The rotating support may therefore be mounted during installation of the door column or at a later point in time.

In one or more examples, the door column comprises a cavity, and the method further comprises mounting the rotating support to rotate between a first position within the cavity to a second position inside the landing doorway. Mounting the rotating support such that it can be positioned within a cavity of a door column reduces the amount of space required in the elevator hoistway that would otherwise be taken up by the rotating support. The Applicant has realised that at least some existing elevator systems include landing doorways comprising door columns in which there is a pre-existing cavity. The Applicant has realised that such a door column cavity can be used to conveniently position a rotating support e.g. in a hidden position within the cavity to store the hoistway access ladder out of sight. As a result, a rotating support may be mounted or retrofitted to the door column of pre-existing elevator systems, improving operator safety when retrieving the hoistway access ladder.

In at least some examples, the rotating support is mounted to a door column of a landing doorway situated at a lowermost landing of an elevator hoistway and the hoistway access ladder is a pit access ladder. Such retrofitting methods provide a rotating support that makes it easier to store and retrieve a pit access ladder, for example for use in elevator hoistways that have a pit depth of less than 2.5 m.

BRIEF DESCRIPTION OF THE DRAWINGS

Certain examples of this disclosure will now be described with reference to the accompanying drawings, in which.

DETAILED DESCRIPTION

Figure 1:
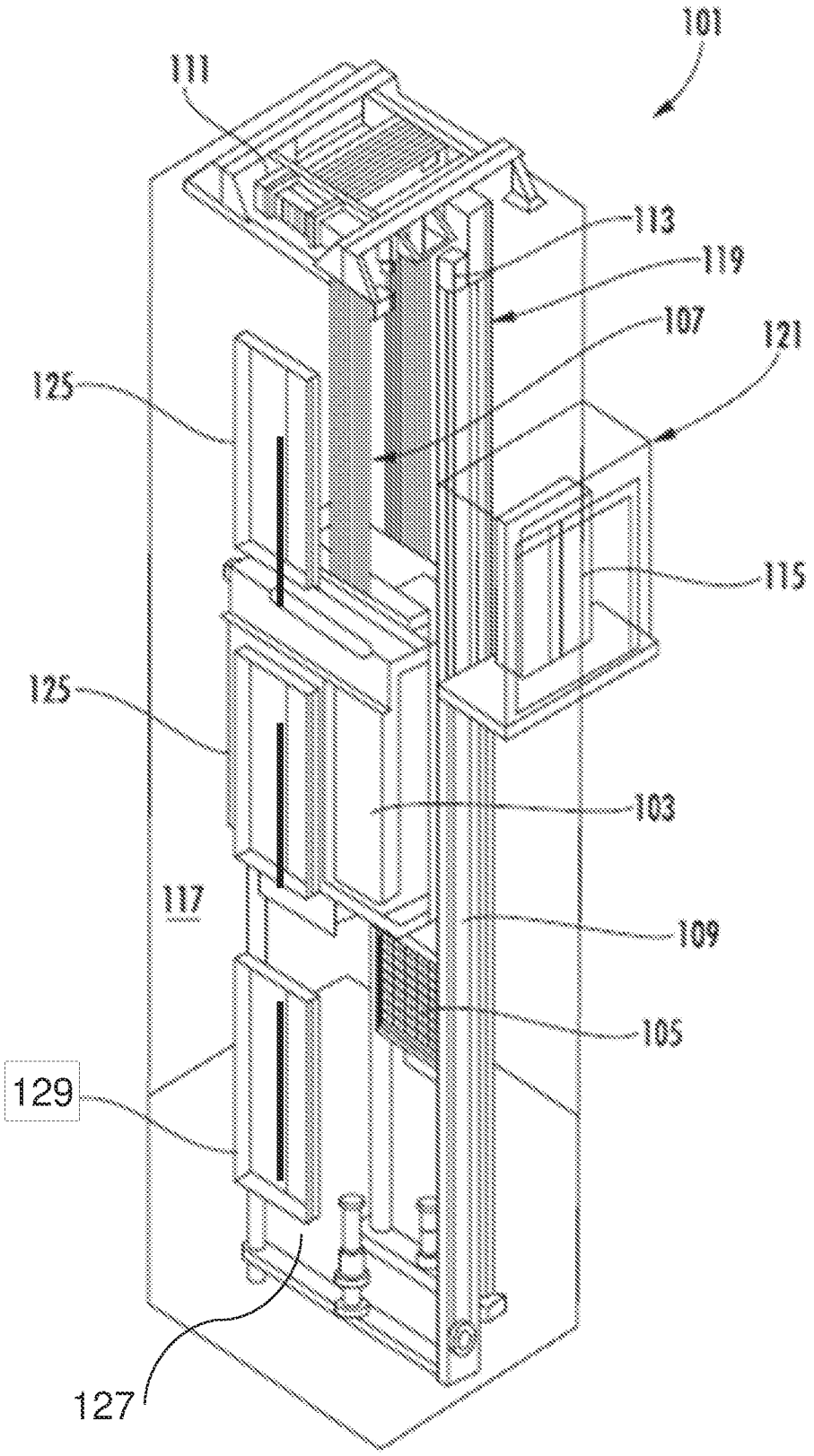
FIG. 1 is a schematic illustration of an elevator system according to examples of the present disclosure.

FIG. 1 is a perspective view of an elevator system 101 including an elevator car 103, a counterweight 105, one or more load bearing members 107, a guide rail 109, a machine 111, a position encoder 113, and an elevator controller 115. The elevator car 103 and counterweight 105 are connected to each other by the load bearing members 107. The load bearing members 107 may be, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator hoistway 117 and along the guide rail 109.

The load bearing members 107 engage the machine 111, which is part of an overhead structure of the elevator system 101. The machine 111 is configured to control movement between the elevator car 103 and the counterweight 105.

The elevator controller 115 is located, as shown, in a controller room 121 of the elevator hoistway 117 and is configured to control the operation of the elevator system 101, and particularly the elevator car 103. For example, the elevator controller 115 may provide drive signals to the machine 111 to control the acceleration, deceleration, levelling, stopping, etc. of the elevator car 103. The elevator controller 115 may also be configured to receive position signals from the position encoder 113. When moving up or down within the elevator hoistway 117 along the guide rail 109, the elevator car 103 may stop at one or more landings 125 as controlled by the elevator controller 115.

The machine 111 may include a motor or similar driving mechanism and an optional braking system. Although shown and described with a rope-based load bearing system, elevator systems that employ other methods and mechanisms of moving an elevator car within an elevator hoistway, such as hydraulics, ropeless, or any other methods, are also examples of the present disclosure. FIG. 1 is merely a non-limiting example presented for illustrative and explanatory purposes.

At the bottom of the elevator hoistway 117, below the lowermost landing 129, is the elevator pit 127. It is often necessary for the elevator pit 127 to be accessed by maintenance personnel in order for inspection or repairs to be carried out. In elevator systems without pit access doors at the bottom of the hoistway, the distance between the lowermost landing 129 and the elevator pit 127 may be up to 2.5 m. For the elevator pit 127 to be accessed safely from the lowermost landing 129, equipment needs to be provided to allow the elevator pit 127 to be accessed. The most common way access is provided is using an elevator hoistway access ladder, such as hoistway access ladder 200 shown in FIG. 2.

Figure 2:
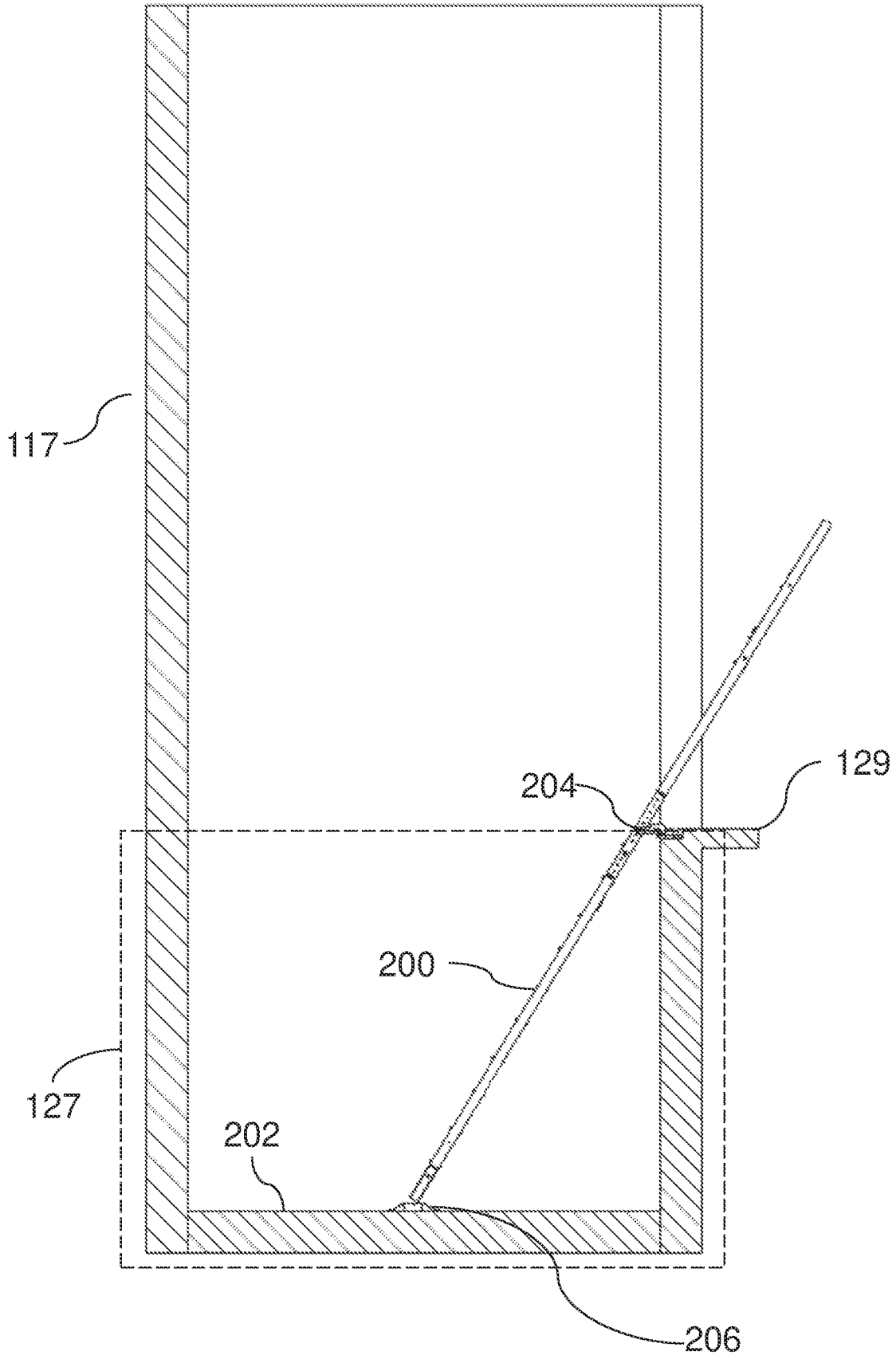
FIG. 2 schematically illustrates deployment of a hoistway access ladder in the pit of an elevator hoistway in accordance with the present disclosure.

FIG. 2 shows an elevator hoistway 117, and elevator pit 127, in which a hoistway access ladder 200 is deployed. The hoistway access ladder 200 provides access to the floor 202 of the elevator hoistway 117 from the lowermost landing 129. During use, the hoistway access ladder 200 is secured at the lowermost landing 129 and the floor 202 of the elevator hoistway 117 by securing means 204, 206.

Although FIG. 2 illustrates a hoistway access ladder 200 being used to provide access to an elevator pit 127 from the lowermost landing 129, it will be appreciated that the hoistway access ladder 200 could also be used at any other landing 125 within the hoistway 117 to provide access to other areas of the hoistway 117. For example, the hoistway access ladder 200 may be used to access the roof of an elevator car (e.g. elevator car 103 of FIG. 1) from any appropriate landing 125.

Many designs of hoistway access ladder are known in the prior art. In the prior art, hoistway access ladders are typically stored close to or within the hoistway, and are typically foldable or retractable in order to limit the amount of storage space required within the hoistway. The design of hoistway access ladders is therefore dependent on the storage method used.

Figure 3A:
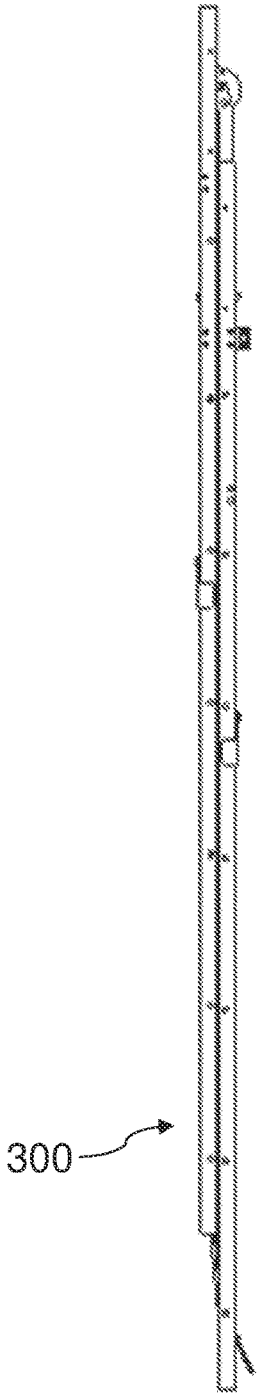
FIGS. 3A and 3B schematically illustrate a hoistway access ladder suitable for use in the system of the present disclosure.
Figure 3B:
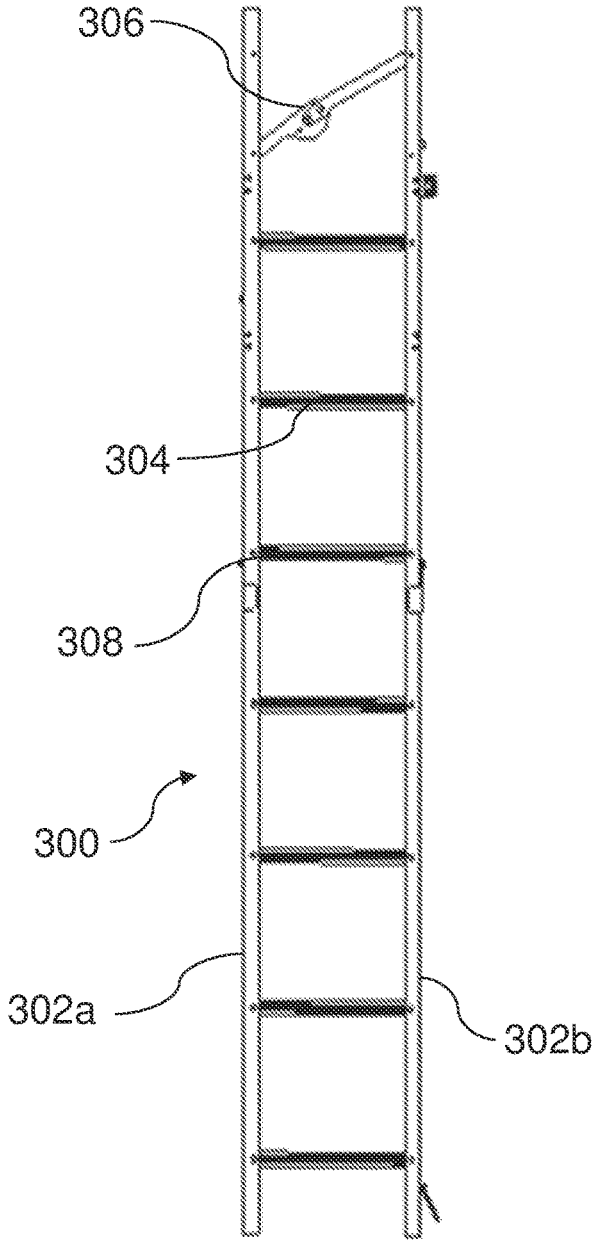

An exemplary hoistway access ladder 300 suitable for use in the systems of the present disclosure is shown in FIGS. 3A and 3B. The hoistway access ladder 300 comprises uprights 302*a*, 302*b* connected by rungs 304, and a locking hinge 306. Locking hinge 306 allows the ladder to be folded between a deployed configuration (shown in FIG. 3B), and a storage configuration (shown in FIG. 3A). As can be seen in FIG. 3A, in the storage configuration, the uprights 302*a* and 302*b* are moved together. When the uprights 302*a* and 302*b* are moved together they become offset, and the uprights 302*a* and 302*b* become aligned when the hoistway access ladder 300 is folded out to the deployed configuration shown in FIG. 3B.

When in the deployed configuration, the locking hinge 306 holds the hoistway access ladder 300 open such that it can be safely used by maintenance personnel. When the hoistway access ladder 300 is to be stored, applying relative motion between uprights 302*a* and 302*b* causes the hinge to unlock and the uprights 302*a* and 302*b* to move together, such that the uprights 302*a* and 302*b* come into contact. To facilitate this, the rungs 304 may be hinged or collapsible. In the example shown in FIGS. 3A, 3B, the rungs 304 are configured to rotate relative to the uprights around a point 308, however in other examples the rungs 304 of the hoistway access ladder 300 may instead be telescopic or may be collapsible by other appropriate means.

The hoistway access ladder 300 is required to be stored close to the elevator hoistway 117 when not in use. In prior art approaches, hoistway access ladders are typically stored within the hoistway itself, for example mounted to one of the hoistway walls. However the present Applicant has realised that storage for a hoistway access ladder 300 can advantageously be provided in a cavity provided within a door column of the doorway of a landing 125, or in a support mounted to a door column of a landing doorway, as is described further below.

FIGS. 4A-4D show a hoistway access ladder storage system 400 according to a first example of the present disclosure. FIGS. 4A-4D each show a landing doorway 402, which may be present at the lowermost landing 129 of the elevator hoistway 117 seen in FIGS. 1 and 2.

Figure 4A:
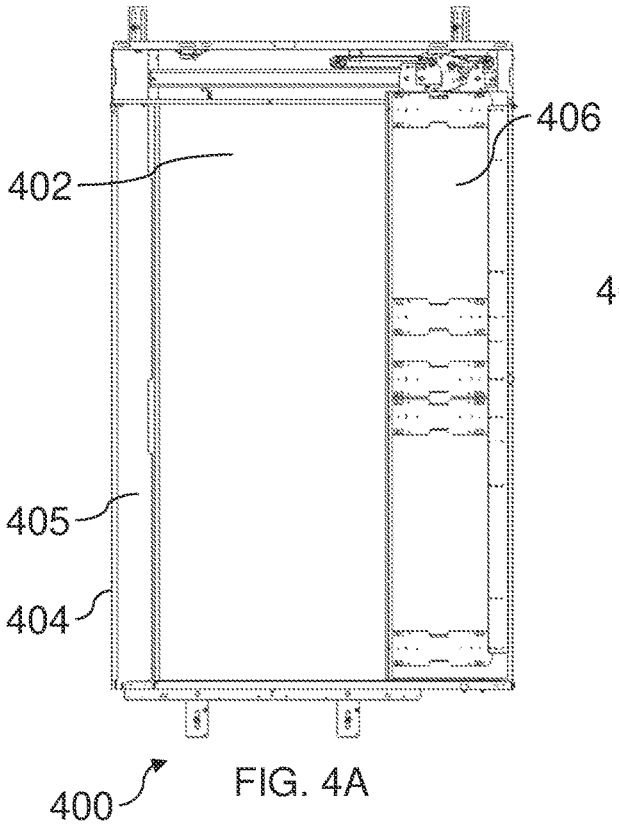
FIGS. 4A-4D schematically illustrate a hoistway access ladder storage system in accordance with a first example of the present disclosure.
Figure 4B:
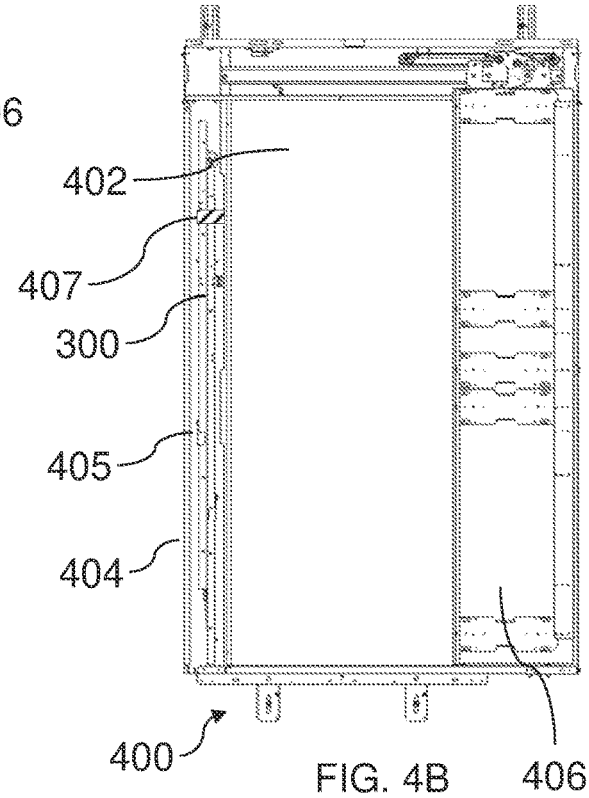
Figure 4C:
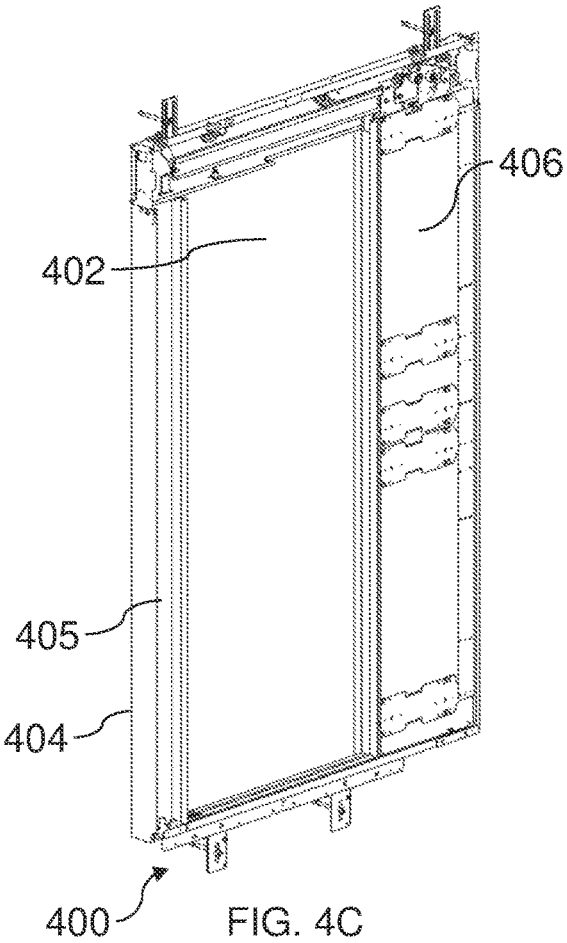
Figure 4D:
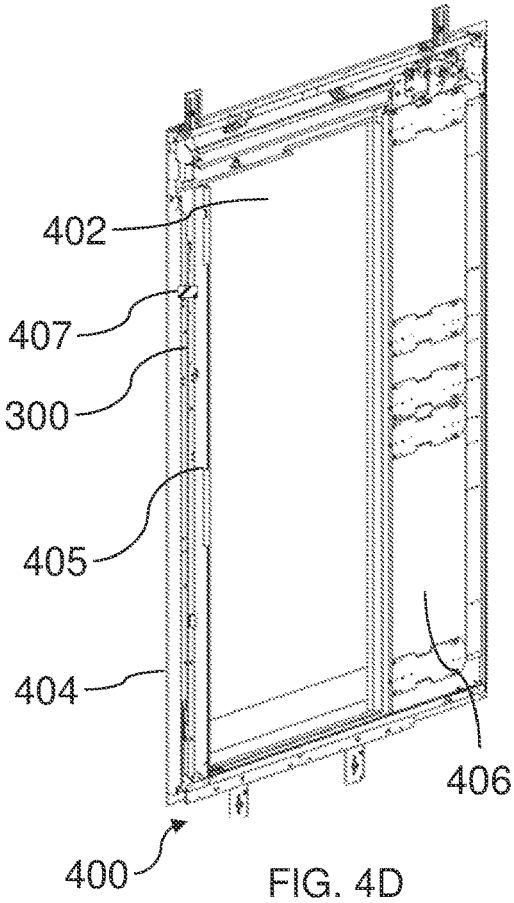

FIGS. 4A and 4B show a side view of the hoistway access ladder storage system 400 as viewed from the hoistway side, i.e. the rear of the landing doorway 402. FIGS. 4C and 4D show an isometric view of the rear side of the hoistway access ladder storage system 400.

The landing doorway 402 comprises a door column 404 and a landing door 406. In the system of the present disclosure, the landing door 406 is a telescopic landing door, however any side opening landing door could be used. A door column 404 is present on at least one side of the landing doorway 402. In this example, the door column 404 is part of a jamb for the landing door 406. The Applicant has realised that the door column 404 can be advantageously made suitable for storing a hoistway access ladder 300, providing access to the hoistway access ladder 300 safely and conveniently, without requiring substantive modification to existing elevator systems.

In the first example shown in FIGS. 4A-4D, the door column 404 comprises a cavity 405, which has dimensions suitable for storing the hoistway access ladder 300. FIGS. 4A and 4C show the hoistway access ladder storage system 400 with the cavity 405 empty, while FIGS. 4B and 4D show the hoistway access ladder storage system 400 with the cavity 405 containing the hoistway access ladder 300.

The hoistway access ladder 300 may be stored in the cavity 405 of the door column 404 without the use of any restraining devices, however in the first example the hoistway access ladder 300 is held within the cavity 405 using a restraining element 407 (seen in FIGS. 4B and 4D), such as a strap or a locking bar. After unlocking or removing the restraining element 407, the hoistway access ladder 300 can simply be lifted out of the cavity 405 when it is required for use. For example, when a maintenance operation such as a pit inspection is carried out, the landing door 406 is opened from the landing side (i.e. the front of the landing door), leaving the doorway 402 open. The hoistway access ladder 300 can then simply be lifted out from the cavity 405 by, e.g. a technician, by reaching through the doorway 402 from the landing side and accessing the cavity 405 on the hoistway side. This allows the hoistway access ladder 300 to be accessed without dangerously reaching out into the hoistway, for example to retrieve an access ladder from a wall of the hoistway, as is known in the prior art. The risk to maintenance personnel in accessing the hoistway access ladder 300 is therefore reduced.

Figure 5B:
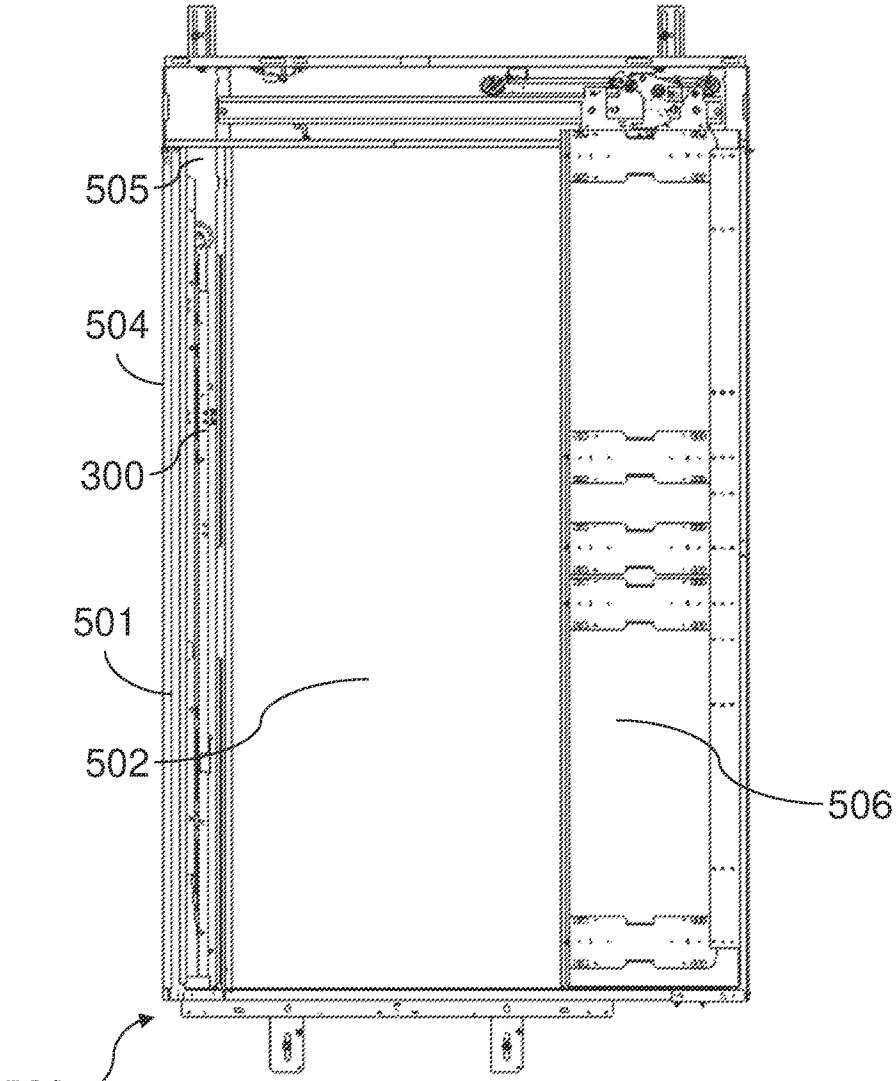
FIGS. 5A and 5B schematically illustrate a hoistway access ladder storage system including a rotating support according to a second example of the present disclosure.
Figure 5A:
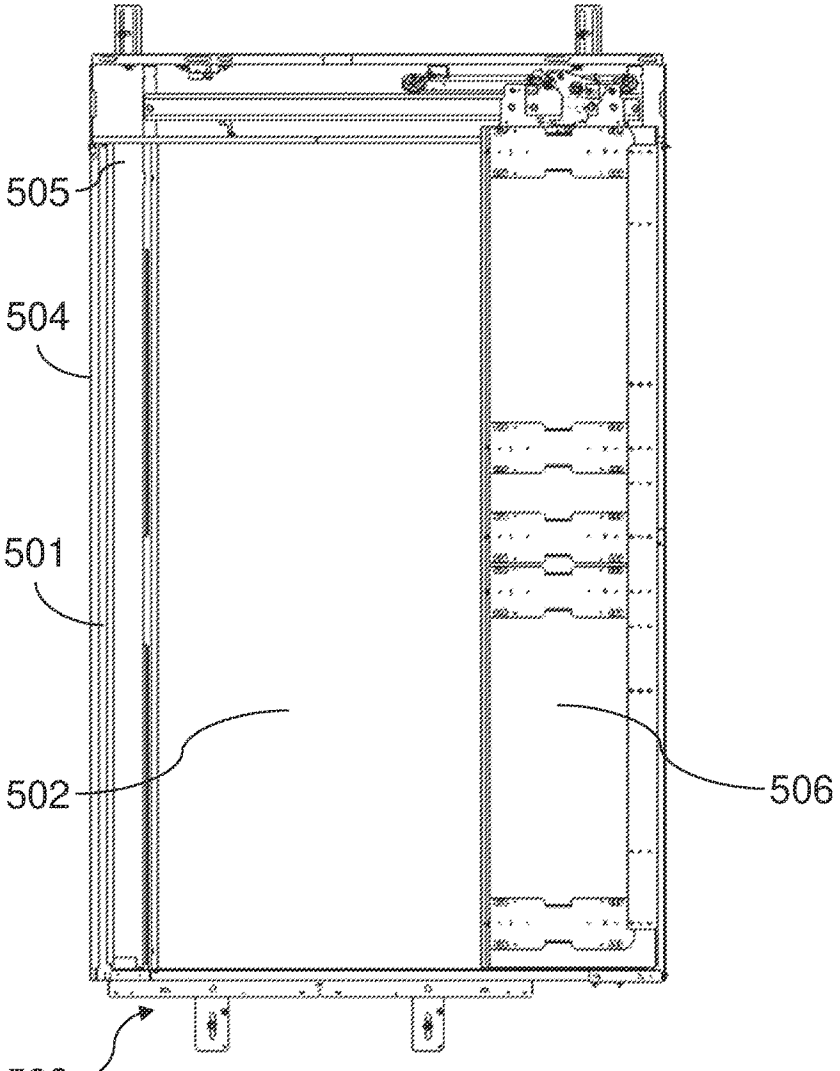

In a second example of this disclosure, shown in FIGS. 5A and 5B, the hoistway access ladder 300 is stored in a different configuration, in which ease of access to the hoistway access ladder is further improved in at least some cases.

FIGS. 5A and 5B show a side view of a hoistway access ladder storage system 500 according to a second example of this disclosure. FIGS. 5A and 5B show a landing doorway 502, as may be employed at the lowermost landing 129 of the elevator hoistway 117 shown in FIGS. 1 and 2, as viewed from the hoistway side, i.e. the rear of the landing doorway 502.

As in the first example described above, the landing doorway 502 comprises a door column 504 and a side opening landing door 506. The door column 504 comprises a cavity 505, which has dimensions suitable for storing the hoistway access ladder 300. FIG. 5A shows the hoistway access ladder storage system 500 with the cavity 505 empty, while FIG. 5B shows the hoistway access ladder storage system 500 with the hoistway access ladder 300 contained within the cavity 505.

In the second example, there is a rotating support 501 mounted to the door column 504 in which the hoistway access ladder 300 can be stored to provide easier retrieval of the hoistway access ladder 300. As can be seen from FIG. 5B, the rotating support 501 is configured to sit entirely within the cavity 505 in a first position. The rotating support 501 is mounted to be rotatable relative to the door column 504 to a second position inside the landing doorway, as will be described below. In this example, the rotating support 501 is mounted to at least one of the walls of the cavity 505 (i.e. an interior surface of the door column 504) by a hinge (not shown), and can rotate out from the cavity 505, through the landing doorway towards the landing. However it will be appreciated that the rotating support 501 may be mounted to the door column 504 in any suitable way, by a hinge or otherwise.

Figure 6A:
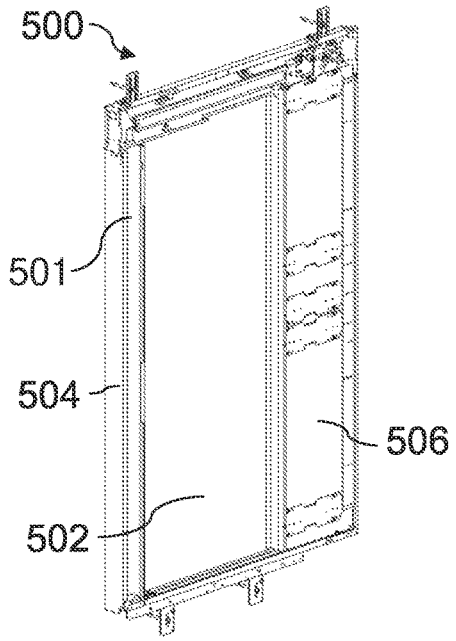
FIG. 6A-6E schematically provide further illustration of a hoistway access ladder storage system including a rotating support according to the second example of the present disclosure.
Figure 6B:
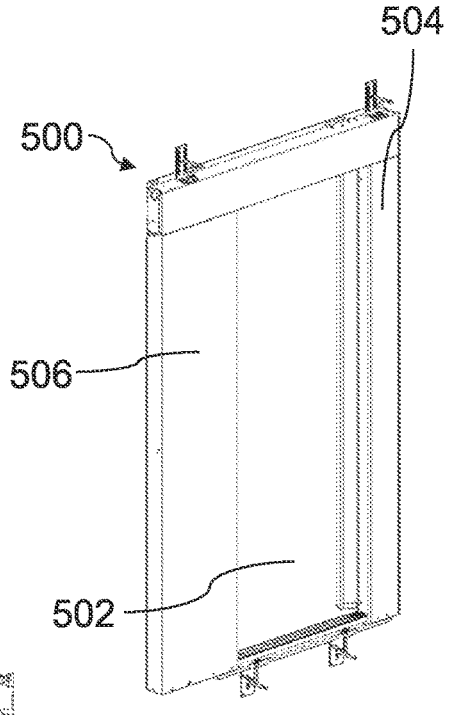
Figure 6E:
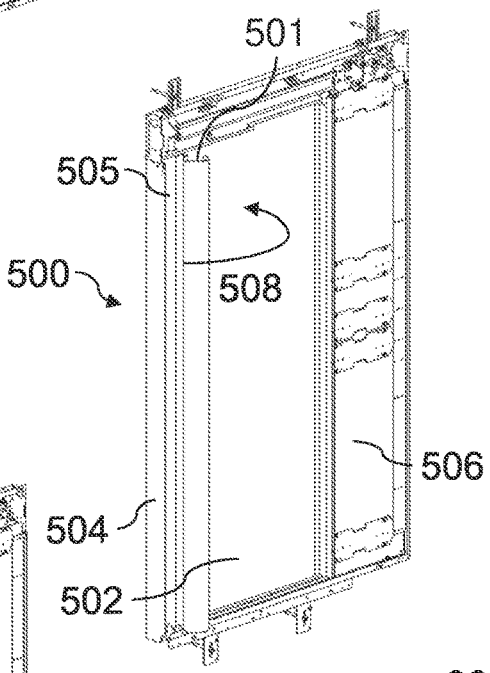
Figure 6C:
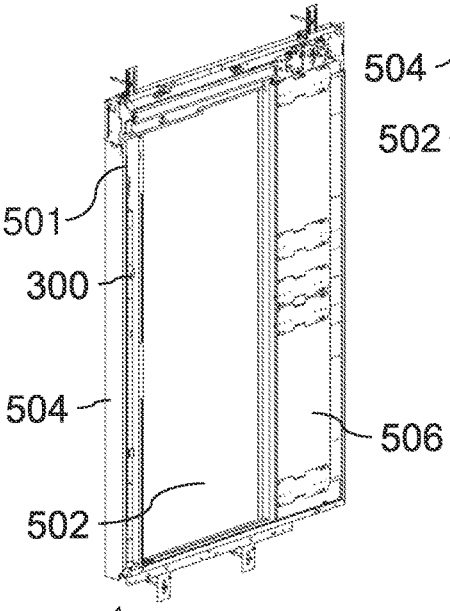
Figure 6D:
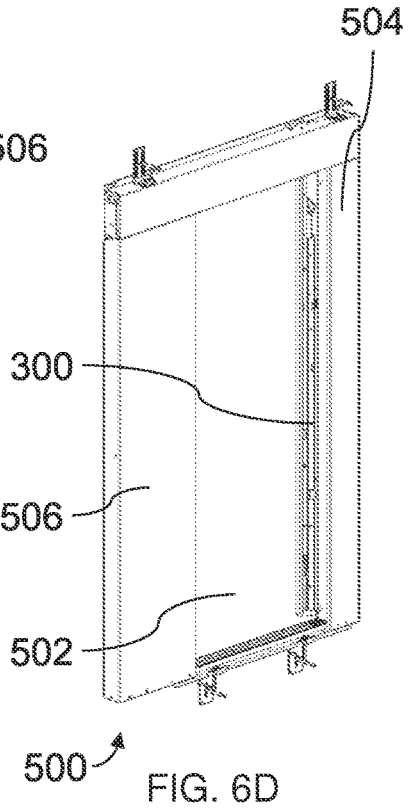

FIGS. 6A-6E show the hoistway access ladder storage system 500 according to the second example from both the landing and hoistway sides of the landing doorway 502. FIGS. 6A, 6C and 6E show an isometric view of the hoistway access ladder storage system 500, as viewed from the hoistway side of the landing doorway 502. FIGS. 6B and 6D show an isometric view of the hoistway access ladder storage system 500 from the landing side of the landing doorway 502. The door column 504 (comprising the cavity 505, shown in FIG. 6E) and side opening landing door 506 are shown in each of FIGS. 6A-6E. The rotating support 501 can be seen in FIGS. 6A, 6C, and 6E. FIG. 6A shows the hoistway access ladder storage system 500 with the rotating support 501 inside the cavity 505 when it is empty, while FIG. 6C shows the hoistway access ladder storage system 500 with the hoistway access ladder 300 contained within the rotating support 501 inside the cavity 505.

The rotation of rotating support 501 is shown in more detail in FIG. 6E, in which the rectangular cross section of the rotating support 501, as well as its direction of rotation (from the cavity 505 on the hoistway side of the landing doorway 502 to the landing side of the landing doorway 502) shown by arrow 508, can be clearly seen.

In this example, the rotating support 501 takes the form of a generally U-shaped sleeve, including a back wall and a pair of side walls. The sleeve of the rotating support 501 has a vertical extent to match the height of the door column 504. However, if the hoistway access ladder 300 is shorter than the door column 504 then the rotating support 501 may only extend along part of the door column 504. The back wall and side walls together define a rectangular cross-section for the rotating support 501, with an open front through which the hoistway access ladder 300 can be placed to be seated between the side walls and against the back wall.

The rotating support 501 may be secured in place within the cavity using a lock, in order to prevent access to the hoistway access ladder 300 to unauthorised persons. When a maintenance operation such as a pit inspection is carried out, the rotating support 501 may be unlocked and rotated out from the cavity 505, through the landing doorway 502 to the landing 125 to provide access to the hoistway access ladder 300 to e.g. a technician.

Figure 7A:
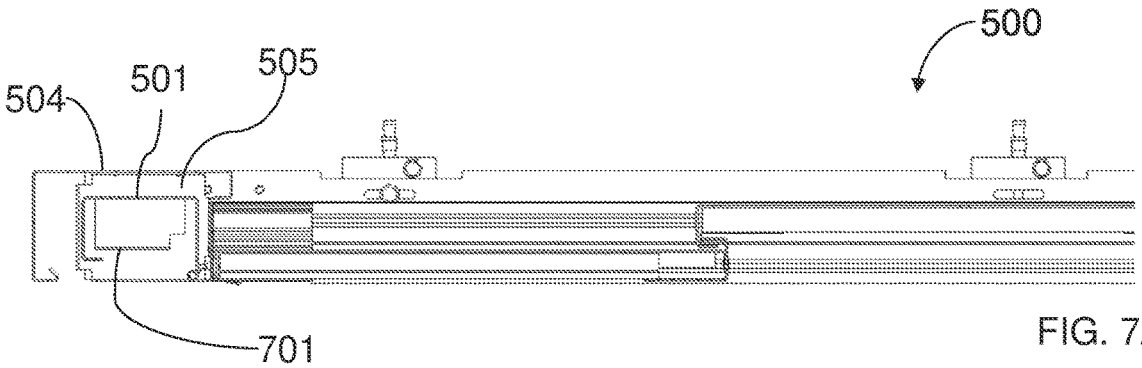
FIGS. 7A-7D schematically illustrate the operation of the rotating support of the hoistway access ladder storage system according to the second example of the present disclosure.
Figure 7B:
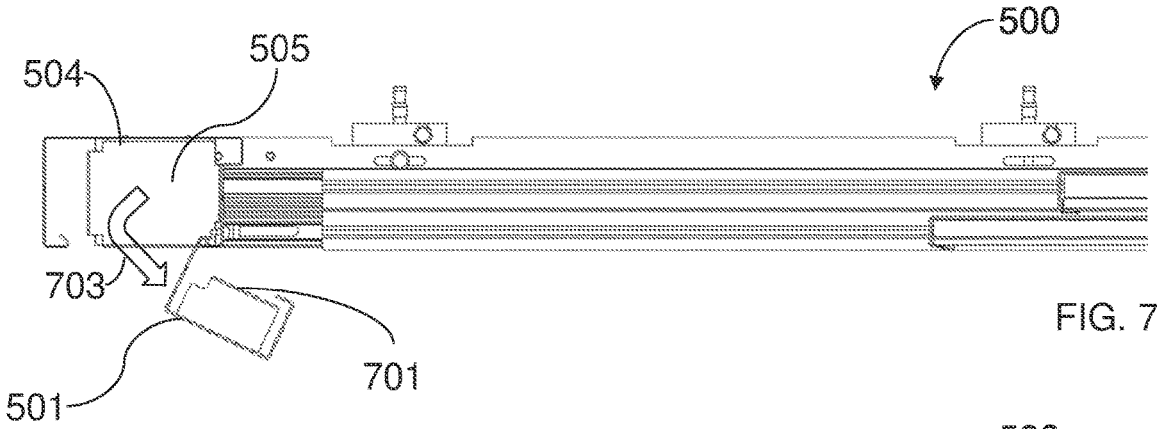
Figure 7C:
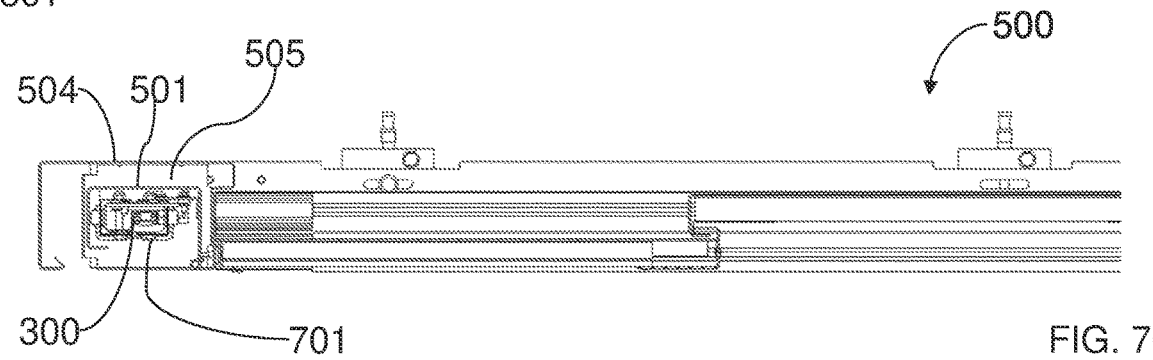
Figure 7D:
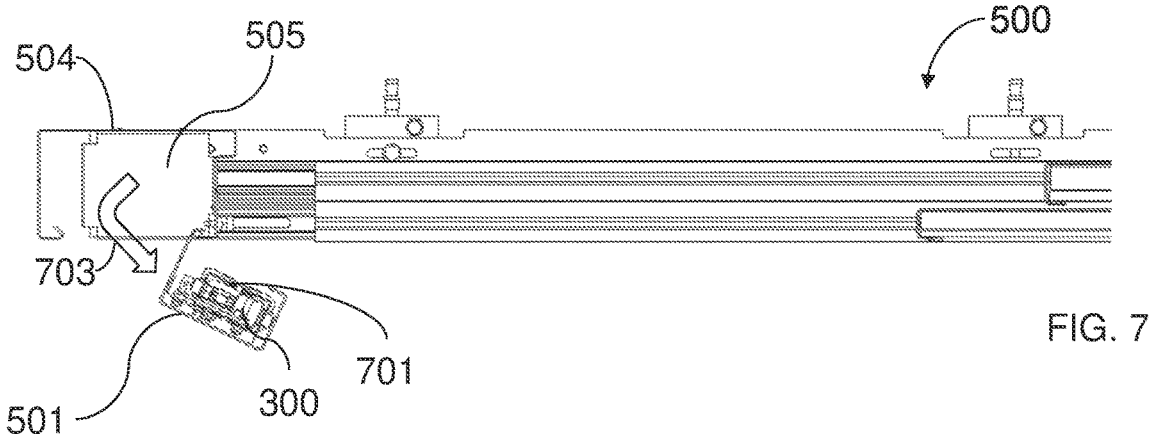

The movement of the rotating support 501 is shown in more detail in FIGS. 7A-7D. FIGS. 7A-7D illustrate a cross-sectional view of the hoistway access ladder storage system 500 of the second example of this disclosure, with a horizontal cross-section taken just below a lintel of the hoistway landing doorway 502. FIGS. 7A and 7B show the hoistway access ladder storage system 500 empty, while FIGS. 7C and 7D show the hoistway access ladder storage system 500 with the hoistway access ladder 300 held within the rotating support 501.

As shown in FIGS. 7A-7D, a door column 504 extends vertically below the lintel of the hoistway landing doorway 502 and has an internal cavity 505, extending vertically within the door column 504. The rotating support 501 is configurable between a first position (shown in FIGS. 7A and 7C), in which the rotating support 501 is fully contained within the cavity 505 of the door column 504, and a second position (shown in FIGS. 7B and 7D), in which the hoistway access ladder 300 is accessible from inside the landing doorway.

FIGS. 7A and 7B show the hoistway access ladder storage system 500 with the hoistway access ladder 300 removed, while FIGS. 7C and 7D show the hoistway access ladder 300 contained within the rotating support 501. The rotating support 501 may be secured in the first position shown in FIGS. 7A and 7C using a lock (not shown), in order to prevent access to the hoistway access ladder 300 to unauthorised persons.

The direction of rotation of the rotating support 501 between the first and second positions is indicated by arrows 703 in FIGS. 7B and 7D. When the hoistway access ladder 300 is required for use, the rotating support 501 can be rotated from the first position inside the cavity 505 to the second position from which the hoistway access ladder 300 can be accessed by e.g. a technician from inside a landing doorway of the hoistway.

When the hoistway access ladder 300 is to be stored within a hoistway, the rotating support 501 can be returned from the second position shown in FIGS. 7B and 7D, to the first position, shown in FIGS. 7A and 7C by rotating the rotating support 501 in the opposite direction.

Also shown in FIGS. 7A-7D is a retaining element 701, which holds the hoistway access ladder 300 in place within the rotating support 501. In the example shown, the retaining element 701 comprises a vertical extension from the base of the rotating support 501, which provides support for the base of the hoistway access ladder 300. However, in other examples the retaining element 701 may be located at one or more different points on the rotating support 501. For example, the retaining element 701 may comprise a bar located at a position approximately at the midpoint of the vertical height of the rotating support 501. Preferably the retaining element 701 is made of metal, but in some examples may be plastic. In some examples, the retaining element 701 may be a strap that can be tightened, opened and closed by an operator. In some examples, multiple retaining elements 701 may be used in combination. The use of the retaining element 701 can be seen in FIG. 7D, which shows the hoistway access ladder storage system 500 with the rotating support 501 in the second position, and the elevator hoistway access ladder 300 secured within the rotating support 501 by the retaining element 701.

Thus, as in the first example shown in FIG. 4, the second example shown in FIGS. 5-7 provides a hoistway access ladder storage system 500 which can be used to access the hoistway access ladder 300 safely and conveniently, without requiring substantial modification to existing elevator systems beyond the installation of a rotating support 501, e.g. taking advantage of any pre-existing cavity 505 of the door column 504. As a cavity 505 compatible with the hoistway access ladder storage system 500 shown in FIGS. 5-7 may already be present in existing elevator landing doorways, such a system is suitable for retrofitting.

It will be appreciated by those skilled in the art that the disclosure has been illustrated by describing one or more specific examples thereof, but is not limited to these examples; many variations and modifications are possible, within the scope of the accompanying claims.

What is claimed is:

1. An elevator hoistway access ladder storage system (500) comprising:

a landing doorway (502), the landing doorway (502) comprising a door column (504) and a landing door (506);

wherein the door column (504) comprises a rotating support (501) for storing a hoistway access ladder within the rotating support (300), the rotating support (501) being rotatable relative to the door column (504);

wherein the door column (504) comprises a cavity (505), and wherein the rotating support (501) is rotatable between a first position inside the cavity (505) and a second position inside the landing doorway (502).

2. The elevator hoistway access ladder storage system (500) of claim 1, wherein the rotating support (501) comprises at least one retaining element (701) arranged to hold the hoistway access ladder (300) in a storage position in the rotating support (501) during use.

3. The elevator hoistway access ladder storage system (400; 500) according to claim, 1 wherein the landing door (406; 506) is a side opening door.

4. The elevator hoistway access ladder storage system (400; 500) of claim 1, wherein the landing door (406; 506) is a telescopic side opening door.

5. The elevator hoistway access ladder storage system (400; 500) of claim 1, wherein the hoistway access ladder (300) is a foldable ladder.

6. The elevator hoistway access ladder storage system (400; 500) of claim 5, wherein the hoistway access ladder (300) comprises a pair of uprights (302*a*, 302*b*) connected by rungs (304), the hoistway access ladder (300) being foldable into a storage configuration by moving the uprights (302*a*, 302*b*) together.

7. An elevator system (101) comprising an elevator car (103) arranged to move in an elevator hoistway (117), and at least one landing (125, 129) in the elevator hoistway (117) comprising a landing doorway (402; 502), wherein the landing doorway (402; 502) comprises the elevator hoistway access ladder storage system (400; 500) according to claim 1.

8. The elevator system of claim 7, wherein the landing doorway (402; 502) is situated at a lowermost landing (129) of the elevator hoistway (117).

9. The elevator hoistway access ladder storage system of claim 1 wherein the door column is part of a jamb for the landing door.

10. The elevator hoistway access ladder storage system of claim 1 wherein the door column is stationary.

11. A method of storing a hoistway access ladder (300) in a landing doorway of an elevator hoistway (117), the method comprising:

mounting a rotating support (501) to a door column of the landing doorway (402; 502), wherein the door column (404; 504) comprises a cavity (405; 505), the rotating support (501) being rotatable relative to the door column (404; 504) between a first position within the cavity (405; 505) to a second position inside the landing doorway (402; 502); and storing the hoistway access ladder (300) in the rotating support (501) in the first position within the cavity.

12. The method of claim 11, wherein the rotating support (501) is mounted to the door column of the landing doorway (402; 502) situated at a lowermost landing (129) of the elevator hoistway (117) and the hoistway access ladder (300) is a pit access ladder.

* * * * *